US005462222A

United States Patent [19]

Boeck, II

[11] Patent Number: 5,462,222

[45] Date of Patent: Oct. 31, 1995

[54] SEALING CLOSURE CLIP FOR GABLE TOP CONTAINER

[76] Inventor: Edgar L. Boeck, II, 265 Riverdale Dr., Fort Lee, N.J. 07024

[21] Appl. No.: 275,543

[22] Filed: Jul. 15, 1994

[51] Int. Cl.[6] ..... B65D 45/16

[52] U.S. Cl. ..... 229/125.39; 229/125.12; 383/69

[58] Field of Search ..... 229/125.08, 125.12, 229/125.37, 125.39, 160.2, 213, 214, 249; 383/69; 24/30.5 R

[56] References Cited

U.S. PATENT DOCUMENTS

| | | | |
|---|---|---|---|
| 2,336,503 | 2/1942 | Ringler . | |
| 2,533,539 | 12/1950 | Vivian | 24/30.5 R |
| 2,629,916 | 3/1953 | Footlick | 24/30.5 R |
| 3,086,264 | 4/1963 | Tindall | 24/30.5 R |
| 3,217,967 | 11/1965 | Jackson | 229/125.08 |
| 3,381,883 | 5/1968 | Harris | 229/125.19 |
| 3,458,110 | 7/1969 | Goldman | 229/125.12 |
| 3,463,380 | 8/1969 | Cooperstein . | |
| 3,680,771 | 8/1972 | Blundson | 229/125.37 |
| 3,693,864 | 9/1972 | Wilkins | 229/125.12 |
| 4,498,585 | 2/1985 | Gordon et al. | 383/69 |
| 4,619,398 | 10/1986 | Laramie | 229/125.12 |
| 4,979,668 | 12/1990 | Allen et al. . | |
| 5,024,375 | 6/1991 | Wright | 229/125.39 |

*Primary Examiner*—Gary E. Elkins
*Attorney, Agent, or Firm*—Klauber & Jackson

[57] ABSTRACT

A narrow, elongated, hard plastic, U-shaped sealing clip for an opened gabled container, providing repeated sealable air tight, leak-resistant closure of the container. Each leg of the U-shaped clip embodies an elongated longitudinally extending bead facing inward of the U, which beads are directly adjacent each other throughout their entire length. The beads are closely spaced and sized to enclose the gabled top of a container, at an upper portion thereof, with a resilient enclosing grip therebetween, to compressively close the portion of the container top which was opened for removal of material from the container. The spacing between the beads is less than the thickness of the container walls whereby, with the slide-on engagement with the gabled top of the container, the sealing clip assumes a compressive V-shaped conformation. The container top function as a track for the beads, during slide-on engagement of the clip with the container and adjacent terminal ends of the beads being cooperatively bevelled to facilitate initial insertion therebetween, of the top of the gable. The end of the elongated U, opposite the insertion end, is closed with an end wall having a partial slit therein. The end wall serves as a positive stop when the clip is fully seated on the container, and as a reinforcing element for the V-shaped compressive conformation during the engagement of the clip with the container.

11 Claims, 1 Drawing Sheet

SEALING CLOSURE CLIP FOR GABLE TOP CONTAINER

FIELD OF THE INVENTION

This invention relates to closures for gable top cartons and containers, and particularly to slide-on closures for such containers.

BACKGROUND OF THE INVENTION

Gable top containers have been widely used in packaging of consumer goods for decades and are familiar to most consumers in the form of the waxed cardboard packaging in which much of the consumer milk and juices are sold. With relatively minor exceptions, the gabled top containers have folded tops which are partially openable with the formation of a dispensing spout. Opposing edges of the walls at the top of the container are sealed closed to each other with an adhesive, thereby forming an upwardly extending ridge which angles out to the container walls.

The standard manner of opening the container comprises pulling a portion of the sealed edges apart, thereby permanently breaking the adhesive bond and permitting pulling out of a folded section to form the spout. Though the spout can be refolded to its original position, the seal remains open, with accessibility of air to the container contents. With contained materials, particularly foods such as milk, which are detrimentally affected by continued exposure to air, failure to completely re-close the container results in substantial loss of shelf life and accelerated spoilage. In addition, the opened seal is susceptible to spillage therethrough, of the container contents, if the container is accidentally tipped or inverted.

Over the years, many closures have been made or suggested for gable top containers, which serve to re-seal the container after the original opening. Some of the closures served the dual purpose of indicating that the container had not been previously opened, in addition to the secondary re-sealing. Closures for gable top containers have almost always been of one of two general types: slide-on closures and container-anchored swivel closures; with the latter requiring separate container engaging and pivoting means.

One of the earliest and simplest of the slide-on closures for gable top containers is disclosed in U.S. Pat. No. 2,336,503, as being a split tube that is cut to size from an extended length of such tubing. In operation, the split section accommodates the upwardly extending portion, or ridge, of the gabled top, when the tube is properly positioned. In a more recent embodiment, in U.S. Pat. No. 3,458,110, various split tube closures are disclosed of configurations including circular, closed rectangular, diamond, triangular, and hexagonal shapes. The closures, in this latter patent, are specifically one-half the length of the container top, in order that they may be moved, by sliding, from the pouring spout area, to the remaining sealed area, without removal of the closure from the container.

Another embodiment of a slidable locking closure is disclosed in U.S. Pat. No. 3,693,864, where the device is described as having a U or V shape, with a closed end; guide means for the sliding engagement; and elements, which cooperate with thickened sections of the container top, to indicate by sight and feel, appropriate positioning.

SUMMARY OF THE INVENTION

Generally, the present invention comprises a slide-on closure clip for gable top type containers, having a sealed ridge thereon, with the sealed ridge being adapted for being at least partially unsealed. The clip has enhanced re-sealing capability, as well as having means for facilitated positioning on the container top and sliding movement thereon. The seal provided by the clip of the present invention is substantially air tight, and sufficiently strong to resist spillage of even the heaviest materials in the largest of gable top containers. In accordance with the present invention, the closure clip of the present invention is comprised of an elongated channel member made of rigid plastic material capable of a limited degree of resiliency and sized to closely fit the ridge at the top of a gabled container. Examples of suitable plastics having the requisite property of rigidity with a limited yet sufficient resiliency, include ABS, styrene, etc.

The channel member comprises two spaced apart, side connected legs in the form of substantially parallel walls having a substantially U-shaped cross section. These legs are connected by a connection member which comprises the base of the U, with the connection member providing a resilient spring-back which resists spreading of the legs. The legs are spaced to closely enclose the ridge of the gable top container therebetween. Each leg comprises an elongated longitudinally extending bead facing inward of the U on the inner surface of the walls, adjacent the mouth of the channel. The beads are directly adjacent each other substantially throughout their entire length, and are closely spaced from each other with a spacing, or very narrow slit, sized such that the much wider ridge of the gable container is enclosed and tightly compressed by the beads. The compression exerted by the beads is a compressively enclosing grip exerted by the connection member.

The beads further comprise means for facilitated positioning of the top of the container therebetween by either, or both, sliding and frictional fit engagement. A stop member at one end of the elongated channel member is configured to provide a stop for the slide-on engagement, when proper positioning is complete, and wherein the stop member also provides compressive reinforcement for the compression of the gable top ridge between the beads but without substantially impeding placement of the channel member on the gable top ridge.

It is an object of the present invention to provide a one piece full length closure clip for a gable type container, having improved sealing capability.

It is a further object of the present invention to provide said closure clip with a facilitated combination of frictional and sliding engagement with the container top and a positive positioning stop.

These and other objects, features and advantages of the present invention will become more evident from the following discussion and drawings in which:

DETAILED DESCRIPTION OF THE INVENTION

Figure 1:
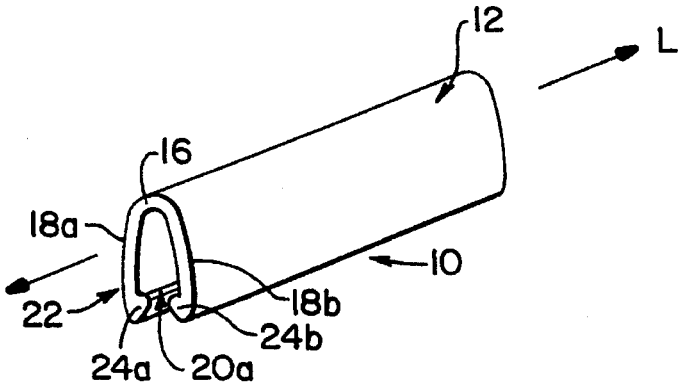
FIG. 1 is an isometric view of the closure clip of the present invention.

In its primary aspect, the closure clip of the present invention comprises:

A. a longitudinally extended strip, said strip defining a pair of lateral edges and a substantially U-shaped longitudinally extending ridge located medial to said lateral edges;

B. a channel defined by said U-shaped ridge for the sliding reception of the ridge of said gable top container;

C. paired legs associated and coextensive with said lateral edges, each of said legs defining inner wall surfaces adjacent to and facing each other for engagement of the said side walls; and D. paired gripping beads defined on said inner wall surfaces for direct contact with said side walls.

The container closure clip of the present invention is fabricated from a flexible material, and may be preferably made from a substantially rigid plastic such as styrene or an ABS resin, which possesses sufficient resilience to permit hinged outward movement of the legs when the ridge at the top of the container is inserted therebetween. Each leg defines at least one integral elongated bead extending along its length and on the inner surface thereof, parallel to the longitudinal axis of the clip at a position that may be closely adjacent the lateral edges of the strip. When the clip is not in use, the respective beads of the legs are closely adjacent one another, and may either touch or may define between them a narrow opening or slit.

The respective beads preferably have cross sectional configurations ranging from a partial arc to a triangle, whereby the portions of the beads most closely adjacent to each other are of the narrowest dimensions. As a result, compressive forces, exerted by the spread-apart legs, are concentrated in the narrowed dimensional portions of the beads which compressively engage the container top. The adjacent partially arcuate or triangular configurations of the beads also function as bevelled insertion means to reduce the effects of resistance from the high compressive forces, during direct placement of the clip on the container top from above.

In a preferred embodiment, the outer surfaces are roughened (in a manner not illustrated) as by knurling, etching, ribbing or the like, to define additional means for stable gripping engagement of the outer side walls of the container ridge. If desired, the clip can be externally printed, etched or molded with decorative, informational or advertising material.

To reduce the effects of resistance from the high compressive forces against the slide-on engagement of closure clip and the ridge of the container, the respective heights of the adjacent beads are also preferably gradually reduced or tapered in the direction from the slide-on insertion end and traveling to the opposite end. Specifically, a bevel may be provided at the insertion end that initially reduces the beads but that gradually decreases to define the corresponding increase of the beads to the desired minimum heights and distance. The cooperative bevel so formed, facilitates the slide-on engagement of the container top.

In a preferred manner of positioning the closure clip of the present invention and as illustrated schematically in FIG. 5, the closure clip is introduced to the ridge of the container top at an angle, and is subsequently slidably advanced into a fully engaged position thereon. The narrowed dimensional portions of the beads also provide reduced resistance to the slide-on engagement movement by lessening the contact area between the clip and the container top.

Figure 6:
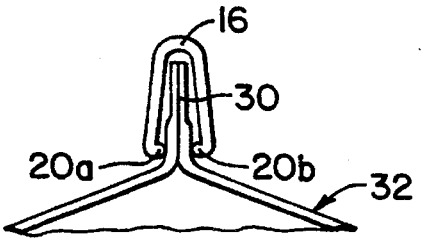
FIG. 6 is a front view of the closure clip in position on the ridge of a gable top container.

As shown in FIG. 6, the end of the closure clip opposite to the slide-on insertion end comprises an integral stop member, that may preferably be defined as a slotted end closure, with the slot being centrally located between the legs and parallel thereto, and defining a U-shape with a smaller separation between the respective legs thereof. The slotted end closure serves the dual function of a stop member and a reinforcement for the compressive forces of the spread apart legs. The slot in the end closure is required for such reinforcement since a fully closed end closure element would prevent or severely retard movement of the legs to accommodate the container top.

Figure 7:
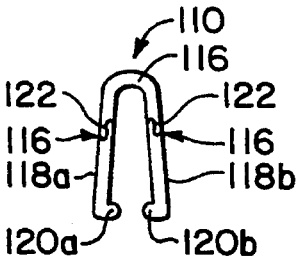
FIGS. 7 and 8 are side views similar to FIG. 4 showing alternative closure clips in accordance with the invention.

In a further embodiment illustrated in FIG. 7, the legs of the clip may be releasably connected to the remainder of the clip body, so that the lateral edges are defined at the point of connection with the legs. This version of the present clip facilitates the replacement of either or any of the components in the event that one or the other should fail, or if it should be desirable to either replace the advertising indicia depicted on the outer surfaces of the legs, or to adjust the size of the complete clip to accommodate containers having differently sized ridges.

DESCRIPTION OF THE DRAWINGS AND THE PREFERRED EMBODIMENTS

Figure 4:
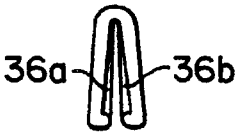
FIG. 4 is a front view of the closure clip.

With specific reference to the drawings wherein like numerals denote like parts, and particularly FIGS. 1 and 4, container closure clip 10 comprises an elongated strip 12 defining lateral edges 14 and a narrow elongated U-shaped ridge 16, defined by parallel legs 18*a* and 18*b*. Beads 20*a* and 20*b* (more clearly seen in FIGS. 2 and 4) extend along the full length of the inner opposed surfaces of legs 18*a* and 18*b*, in a direction parallel to longitudinal axis L, of closure clip 10.

Figure 2:
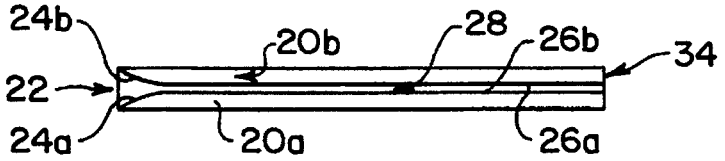
FIG. 2 is a bottom view of the closure clip.

Referring now to FIG. 2, the infeed end 22 of clip 10 defines a means facilitating the sliding engagement of the clip with the container ridge. Specifically, beveled infeed surfaces 24*a* and 24*b* are defined in the leading edges of beads 20*a* and 20*b* and taper away therefrom whereby the beads correspondingly gradually increase in size and closeness to each other. As a result of the cooperation of beveled surfaces 24*a* and 24*b*, and adjacent bead edges 26*a* and 26*b*, the adjacent beads 20*a* and 20*b* define a narrow closely spaced slit 28 therebetween, within and through which, container top 30 of container 32 is fitted (as seen in FIGS. 5 and 6).

Figure 3:
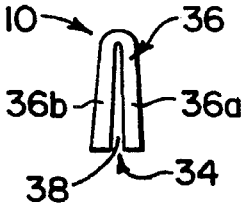
FIG. 3 is a rear view of the closure clip.

As stated earlier and with continuing reference to FIG. 2, bead edges 26*a* and 26*b* extending back from infeed end 22 of closure clip 10, guide the container top 30 into sliding engagement with clip 10. The opposing end 34 of closure clip 10 best illustrated in FIGS. 2 and 3, is substantially closed with split closure element 36. The split closure element 36 provides a stop for the slide-on movement of container top 30, when the clip is fully seated on the container.

Specifically, and with comparative reference to FIGS. 3 and 4, closure element 36 comprises paired juxtaposed end wall elements 36*a* and 36*b* that between them define a reduced slit space 38. The presence of slit space 38 enables the flexure of legs 18*a* and 18*b* while defining a partial wall (see FIG. 4), that enables clip 10 to come to rest in proper alignment with the longitudinal extent of container top 30. In addition, end wall elements 36*a* and 36*b* provide a resilient reinforcement of the compression pressure of the legs 18*a* and 18*b* on container 32 to reinforce the seal between beads 20*a* and 20*b* with the ridge of container top 30. Such resilient reinforcement is achieved without obstructing the initial placement of the clip on the container, since its effect is initially distal to the point of engagement of the container top 30 by clip 10 and beads 20*a* and 20*b*. In addition, the split 38 is distinguishable from the full closures of the prior art, and as stated above, allows legs 18*a* and 18*b* to be deflected away from each other to an extent sufficient to enable clip 10 to readily engage container top 30.

Figure 5:
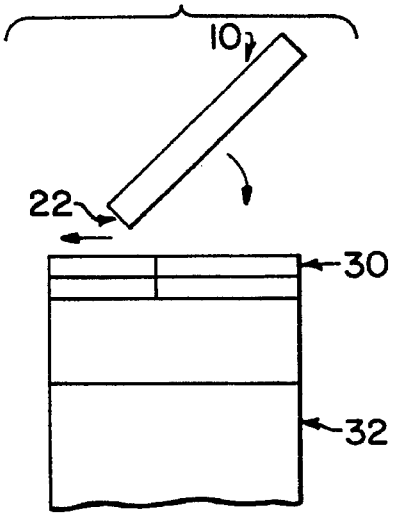
FIG. 5 is a view of the closure clip being placed on a container.

As shown in FIG. 5, a particularly facile method of utilizing the clip 10, with emplacement on container top 30 is by initially engaging bevelled infeed end 22 at an angle, with the relatively thin ridge of container top 30. After such initial engagement, the rear of the clip 10 may then be pressed down (shown by the arrow), on the container top 30 with the top being guided by beveled infeed surfaces 24*a* and 24*b*, between beads 18*a* and 18*b*, and into full insertion position within slit 28. The clip 10 is then caused to slide into position to fully close container 32.

For maximum tension, as shown in FIG. 6, the legs 18*a* and 18*b* are spaced and hinged from each other by a hinge section defined at U-shaped ridge 16, sized to be only slightly larger than the width of the container top 30. The thickness of the container top 30 causes legs 18*a* and 18*b*, to hinge away from each other, with the clip assuming a tensioned V-shaped cross section. The portions of beads 20*a* and 20*b*, which engage the container top, i.e., the respective portions which are directly adjacent one another; are desirably of reduced, or narrowed, dimensions to concentrate compression forces but with sufficient resiliency of engagement to permit sliding movement of the clip on the container top.

The clip 10, is shown in one closure position, i.e., with the open end 22, closing the opened portion of the container top 30. However, the position of the clip, relative to the container top, can just as easily be reversed. Closed end 34 can be positioned at the opened portion of the container top 30, with similar effect, and with the advantages of enhanced leakage resistance afforded by the end wall elements 36*a* and 36*b*. In addition, the enhancement of leg compression afforded by the end wall elements 36*a* and 36*b* is greatest directly adjacent thereto.

A first alternative embodiment of the invention is illustrated in FIG. 7, wherein like numerals are used to denote like parts, increased by 100. Thus, clip 110 comprises a strip 112 having lateral edges 114 and a U-shaped ridge 116. In this embodiment, edges 114 are detachably attachable to legs 118*a* and 118*b*, and as illustrated, may connect by a hinge means 122, such as the "S" connection schematically depicted. Naturally the particular connection may vary, with dovetail joints, snap fittings and the like being exemplary, and the choice of a particular connection being within the discretion of the artisan.

As mentioned earlier, this construction permits the replacement of the legs 118*a* and 118*b* to depict alternate indicia, to change the size or shape of beads 120*a* and 120*b*, or the space defined between them, or to permit the repair of legs that may have broken or may be excessively worn. In similar fashion, the central portion of the clip 110 may be replaced for the same reasons, in the instance where it is desirable to reuse the legs 118*a* and 118*b*.

Figure 8:
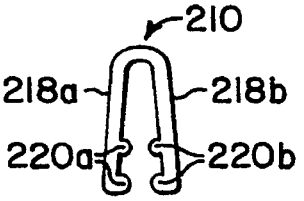

A further alternate embodiment of the invention is illustrated in FIG. 8, also, wherein like parts are denoted by like numbers, increased herein by 200. Thus, clip 210 is similar in virtually all respects to clip 10 of FIG. 1, with the exception of plural beads 220*a* and 220*b* defined on the inner surfaces of respective legs 218*a* and 2218*b*. While not denominated individually, beads 220*a* and 220*b* provide plural levels of contact with the ridge of the container top (not shown in this Figure), and by this contact further secure the fluid tight nature of the closure. Also, although not specifically illustrated, the upper pair of beads 220*a* and 220*b* could define between them a space that is smaller or otherwise differs in size from the space defined between the lower pair. This would be particularly useful in the instance where the size of the ridge of the container top varies correspondingly, and a more custom designed fit and closure is desired.

It is understood that the above description and drawings, showing the preferred embodiment, are only illustrative of the present invention and that changes may be made to the elements, configuration and relative positioning of the components of the clip of the present invention without departing from the scope of the present invention as defined in the following claims.

What is claimed is:

1. A closure clip for the releasable fluid-tight engagement of the ridge of a gable top container, which ridge is defined by the closed spout disposed at the top of said container, that is initially sealed after the container is filled with a fluid to be dispensed, to reseal said ridge after breaking the initial closure seal of said spout, by compressing the outer adjacent side walls of the container defining said ridge, said closure clip comprising:

A. a longitudinally extended strip, said strip defining a pair of lateral edges and a substantially U-shaped longitudinally extending ridge located medial to said lateral edges;

B. a channel defined by said U-shaped ridge for slidably receiving the ridge of said gable top container, said slide-on insertion end for sliding the container ridge therein and wherein the respective beads are adjacently cooperatively tapered with a reduction in height, at a position near said insertion end, to said insertion end, whereby the cooperatively tapered beads function as a bevelled guide for the slide-on insertion of said ridge;

C. paired legs associated and coextensive with said lateral edges, each of said legs defining inner wall surfaces adjacent to and facing each other for engagement of the said container side walls; and D. paired gripping beads defined on said inner wall surfaces for direct contact with the said container side walls;

E. wherein the beads are disposed with respect to each other such that the said container side walls are compressed by said beads into said fluid tight engagement with a resilient compressively enclosing grip.

2. The closure clip of claim 1, wherein said beads are respectively dimensionally narrowed at a position where they are directly adjacent each other.

3. The closure clip of claim 2, wherein said beads are respectively dimensionally narrowed by being rounded.

4. The closure clip of claim 2, wherein said beads are respectively dimensionally narrowed by coming to a point.

5. The closure clip of claim 2, wherein the dimensional narrowing of the beads is positioned and adapted to provide a cooperative bevelled guide for inserting the container ridge between the beads.

6. The closure clip of claim 1, wherein said channel further comprises means for reinforcing said compressively enclosing grip.

7. The closure clip of claim 6, wherein the channel comprises a slide-on insertion end and a substantially closed end, with the closed end, comprising means for stopping slide-in insertion of the ridge with proper positioning of the ridge within said channel.

8. The closure clip of claim 7, wherein said closure end defines a slot in a direction parallel to said legs, whereby said closure member comprises said reinforcing means.

9. The closure clip of claim 1 wherein said legs are integral with said strip.

10. The closure clip of claim 1 wherein said legs are releasably connected with said strip proximal to said U-shaped ridge.

11. The closure clip of claim 1 wherein plural beads are defined on each of said inner wall surfaces.

* * * * *